United States Patent [19]

Scharch

[11] Patent Number: 5,054,363

[45] Date of Patent: Oct. 8, 1991

[54] MULTI-CHANNEL APPARATUS FOR VISUALLY INSPECTING AND PACKAGING LOOSE AMMUNITION CARTRIDGES

[76] Inventor: Daniel J. Scharch, 6589 County Rd. 105, Salida, Colo. 81201

[21] Appl. No.: 466,869

[22] Filed: Jan. 18, 1990

[51] Int. Cl.[5] ..... F42B 39/00

[52] U.S. Cl. ..... 86/47; 42/87; 198/399; 221/254

[58] Field of Search ..... 42/87; 86/47, 48; 198/399, 400; 221/157, 200, 254; 53/55

[56] References Cited

U.S. PATENT DOCUMENTS

| | | | |
|---|---|---|---|
| 2,365,158 | 12/1944 | Wallick | 86/47 |
| 2,735,598 | 2/1956 | Messinger | 86/47 |
| 3,628,273 | 12/1971 | Lach | 42/87 |
| 3,850,289 | 11/1974 | Behr et al. | 198/399 |

*Primary Examiner*—Brian S. Steinberger
*Attorney, Agent, or Firm*—Dorr, Carson, Sloan & Peterson

[57] ABSTRACT

The current invention is a multi-channel apparatus for inspecting and packaging loose ammunition cartridges into containers such as boxes or trays. The operation of the apparatus is largely automatic so that a single operator can inspect for defects and load into containers up to 28,000 rounds of both rim or rimless cartridges as well as various sizes of ammunition per hour with little manual labor involved.

The apparatus includes a frame having an upstanding portion and a horizontal table portion. A reservoir for holding the bulk ammunition in loose form is mounted on the top of the upstanding portion of the frame. The apparatus also includes a mechanism for sorting and feeding the ammunition into feed tubes which feeds the ammunition down onto a conveyor table. The conveyor table moves the ammunition in an ordered fashion through an inspection area to an orienting device where the cartridges are oriented nose downward and directed into a loading mechanism. The loading mechanism loads the cartridges into the containers a row at a time until the container is filled.

24 Claims, 7 Drawing Sheets

MULTI-CHANNEL APPARATUS FOR VISUALLY INSPECTING AND PACKAGING LOOSE AMMUNITION CARTRIDGES

BACKGROUND OF THE INVENTION

1. FIELD OF THE INVENTION:

This invention relates to the field of inspecting and packaging bulk amounts of loose ammunition cartridges into containers to be packaged.

2. STATEMENT OF THE PROBLEM:

Typically, ammunition cartridges such as 0.38 caliber cartridges, are manufactured and initially handled in bulk amounts by weight. The cartridges are then either sorted and placed in packaging boxes manually which is extremely slow and laborious or dumped into a vibratory shaker such as the CASE VIBRATORY INSPECTION TABLE manufactured by Rosan Enterprises, Newport Beach, Calif.

The vibratory shakers use a reservoir by which the loose ammunition is dumped into, and a shaking table which vibrates the loose ammunition downward into position in rows of slots. The cartridges are kept from falling through by the rims of the cartridges. The cartridges can then be partially inspected, counted and then manually deposited into containers.

The vibratory shakers are limited to a particular size of cartridge. The shakers are also unable to handle rimless cartridges such as 9 mm cartridges. There is limited visual inspection and the speed of the operation limited by the speed of the manual labor of the operator.

There currently exists a need for an apparatus which will automatically load a variety of differing sizes of rim and rimless cartridges in a high speed operation and allow visual inspection of the cartridges for defects.

3. Solution to the problem:

The present invention provides an apparatus which will load bulk loose ammunition in an automatic high speed operation regardless of the size or whether the cartridges are rim or rimless. The invention also allows the operator to inspect the entire cartridge as it is being loaded into containers.

The apparatus is operated by one to two people without requiring intensive repetitive manual labor.

The apparatus is easily converted to sort and load various sizes of ammunition cartridges.

These and other objects of the invention will be described by the description of the preferred embodiment in conjunction with the drawings.

STATEMENT OF THE INVENTION

The current invention is a multi-channel apparatus for inspecting and packaging loose ammunition cartridges into containers such as boxes or trays. The operation of the apparatus is largely automatic so that a single operator can inspect for defects and load into containers up to 28,000 rounds of ammunition per hour with little manual labor involved. Both rim or rimless cartridges can be easily handled by this apparatus as well as various sizes of ammunition.

The apparatus includes a frame having an upstanding portion and a horizontal table portion. A reservoir for holding the bulk ammunition in loose form is mounted on the top of the upstanding portion of the frame. The apparatus also includes a mechanism for sorting and feeding the ammunition into feed tubes which feeds the ammunition down onto a conveyor table. The conveyor table moves the ammunition in an ordered fashion through an inspection area to an orienting device where the cartridges are oriented nose downward and directed into a loading mechanism. The loading mechanism loads the cartridges into the containers a row at a time until the container is filled. The filled containers are then moved to a stacking table.

BRIEF DESCRIPTION OF THE DRAWINGS

FIG. 3(*b*) is a view showing the cartridges being guided into the feed holes.

DETAILED DESCRIPTION OF THE PREFERRED EMBODIMENT

The current invention is a multi-channel apparatus for inspecting and packaging loose ammunition cartridges. The apparatus of the current invention is designed to process large capacities of loose ammunition from bulk form into containers such as boxes or trays. The apparatus enables an operator to visually inspect the cartridges for defects as they are being loaded into the containers. The operation of the apparatus is largely automatic so that a single operator can load and inspect up to 28,000 rounds of ammunition per hour with little manual labor involved. Both rim or rimless cartridges can be easily handled by this apparatus.

Figure 1:
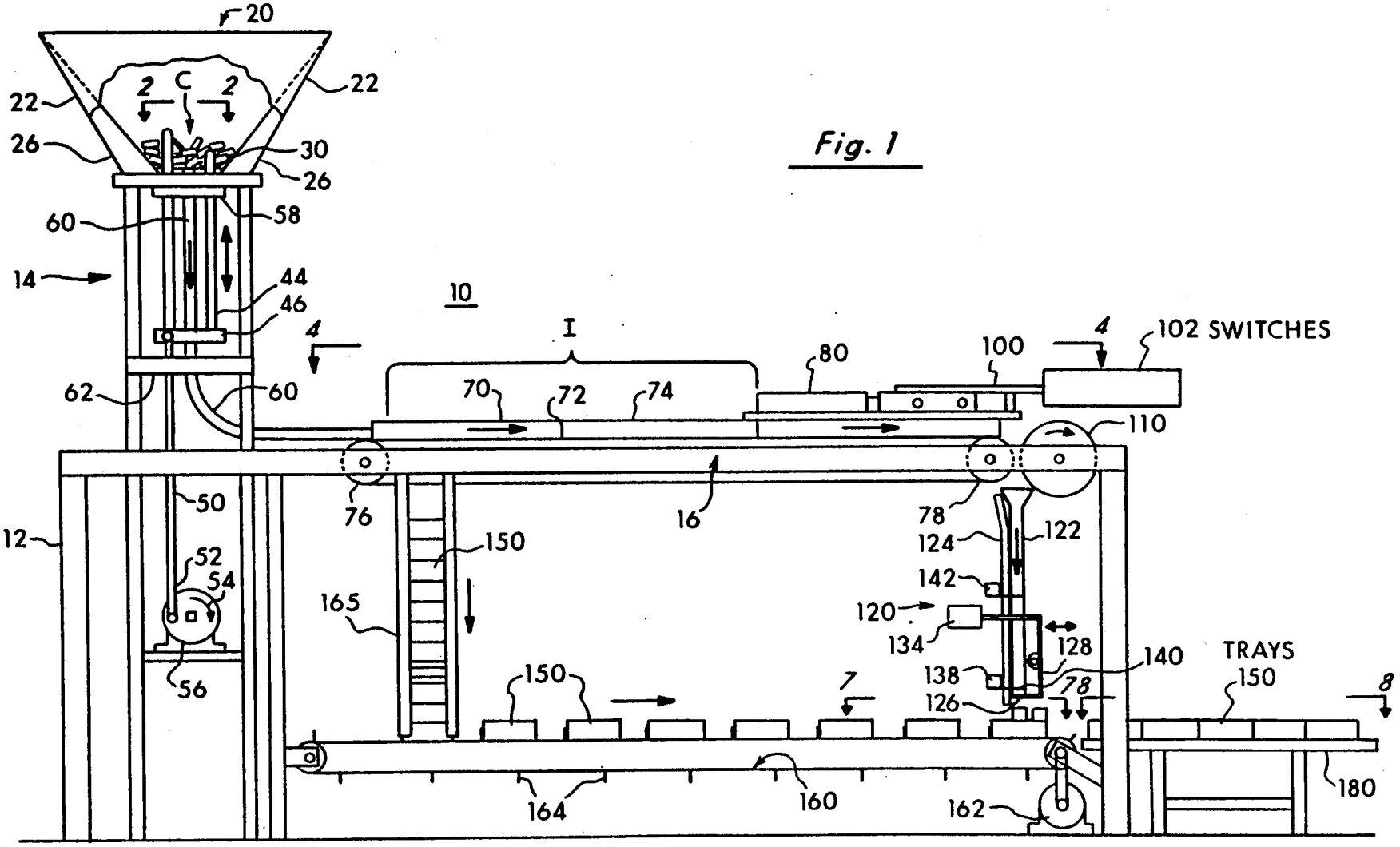
FIG. 1 is a side view of the preferred embodiment of the invention.

The apparatus of the current invention is illustrated in FIG. 1. The apparatus 10 includes a frame 12 having an upstanding portion 14 and a horizontal table portion 16. A reservoir 20 for holding the bulk ammunition in loose form is mounted on the top of the upstanding portion 14 of the frame 12. The apparatus also includes a mechanism for sorting and feeding the ammunition into feed tubes which feeds the ammunition down onto a conveyor table. The conveyor table moves the ammunition in an ordered fashion through an inspection area I to an orienting device where the cartridges are oriented nose downward and directed into a loading mechanism. The loading mechanism loads the cartridges into the containers a row at a time until the container is filled. The filled containers are then moved to a stacking table.

The apparatus and the operation of the apparatus will be fully described in the detailed description of the invention below.

DETAILED DESCRIPTION OF THE STRUCTURE

Figure 2:
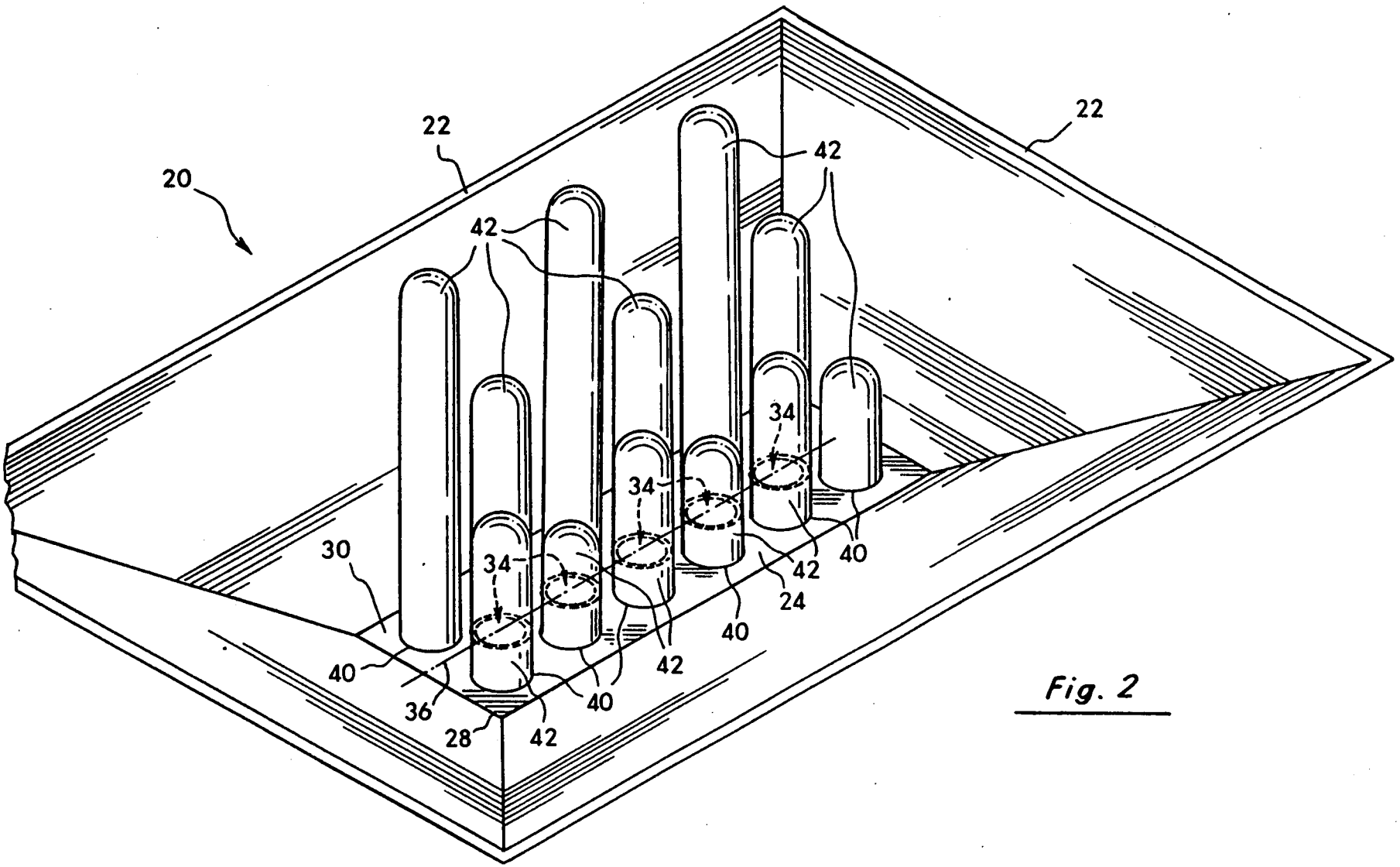
FIG. 2 is a perspective view of the reservoir.

The reservoir: The reservoir 20 of the invention is designed to handle ammunition cartridges C in loose bulk form. The reservoir as illustrated in FIGS. 1 and 2 is an open-topped container mounted on the upper end of the frame 14 with sheet metal sides 22 extending upwardly and outwardly from a rectangular-shaped bottom 24 at a forty-five degree angle. The lower portions 26 of the sides of the reservoir are formed of perforated sheet metal to enable the debris of the bulk ammunition cartridges C to drop through without interfering with the operation of the apparatus. The reservoir 20 is designed to hold a capacity of 2500 rounds of loose ammunition cartridges.

The bottom of the reservoir includes a central rectangular opening 28 into which a feed block 30 is mounted. The feed block 30 has five feed holes 34 spaced apart from one another along the center longitudinal axis 36 of the feed block 30. The current invention is not meant to be limited by the use of five feed holes. The number of holes depends on the number of tracks to be used and the number of holes in the rows of the containers to be filled. The feed holes 34 have a diameter larger than the diameter of the ammunition cartridges C to be loaded through the apparatus but smaller than the length of the cartridges. The feed block 30 is designed to be interchangeable with other feed blocks adapted for other sizes of cartridges.

Surrounding the feed holes 34 in a closely spaced square pattern are dowel rod holes 40. Dowel rods 42 are mounted in the dowel rod holes 40 to vertically reciprocate through the feed block 30. The spacing of the dowel rod holes 40 and dowel rods 42 about the feed holes 34 are such to allow the cartridges to fall within the square spacing pattern but prevent the cartridges from falling between the dowel rods 42. The dowel rods 42 are formed in differing heights and mounted such that no adjacent dowel rods are the same height. The lower ends 44 of the dowel rods 42 are mounted on a rectangular plate 46 which is slidably mounted on the upstanding arms of the frame 14. Arms 50 are mounted on the respective ends of the plate 46. The lower ends 52 of the arms 50 are secured to crank arms 54 which are mounted to a drive motor 56. The motor 56 rotates the crank arms 54 which moves the plate 46 and thus drives the dowel rods 42 to vertically reciprocate through the reservoir 20 and the loose ammunition therein.

Figure 3A:
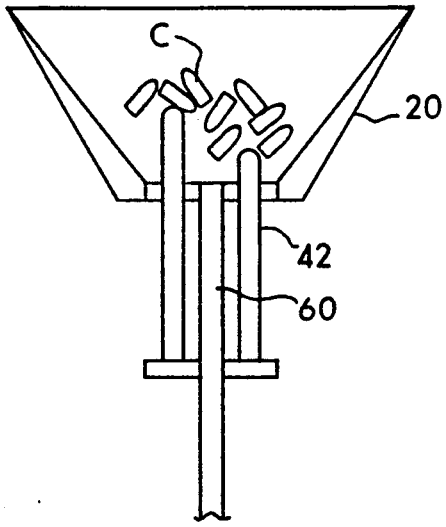
FIG. 3(*a*) is a view showing the dowel rods tilting the cartridges.
Figure 3B:
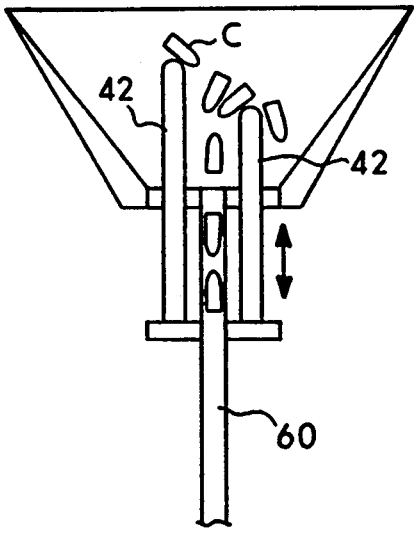

The dowel rods 42 are formed with rounded tops so as the rods 42 are driven upwards through the loose ammunition cartridges, cartridges are tilted by the staggered heights of the rods 42 to fall down into the square spacing pattern of the rods as illustrated in FIG. 3(*a*). As the rods 42 descend, the cartridges which have fallen into the spaced area formed by the dowel rods 42 are guided into the feed holes 34 formed in the feed block 30 as illustrated in FIG. 3(*b*). At this point, it is not important whether the cartridges are nose downward or nose upward.

Mounted to the feed block 30 on the outside of the reservoir 20 is a rectangular block 58 formed of a abrasive resistant material such as Nylatron through which the dowel rods 42 are able to vertically move. Feed tubes 60 are mounted to the block 58 aligned with the feed holes 34 in the feed block 30 and extend downwardly through the plate 46 and through a support plate 62 on the frame. In the preferred embodiment, copper feed tubes 60 are used but the invention is not meant to be limited to the use of copper tubes. Other materials can be used within the scope of the current invention. The cartridges descend from the feed block 30 down into the block 58 where they enter the feed tubes 60. The feed tubes 60 curve downwardly to the conveyor table 70 where they open up on the conveyor belt 72 and into the feed channels 74. The cartridges fall due to gravity downward through the feed tubes 60 onto the conveyor table 70 into the feed channels 74.

Figure 4:
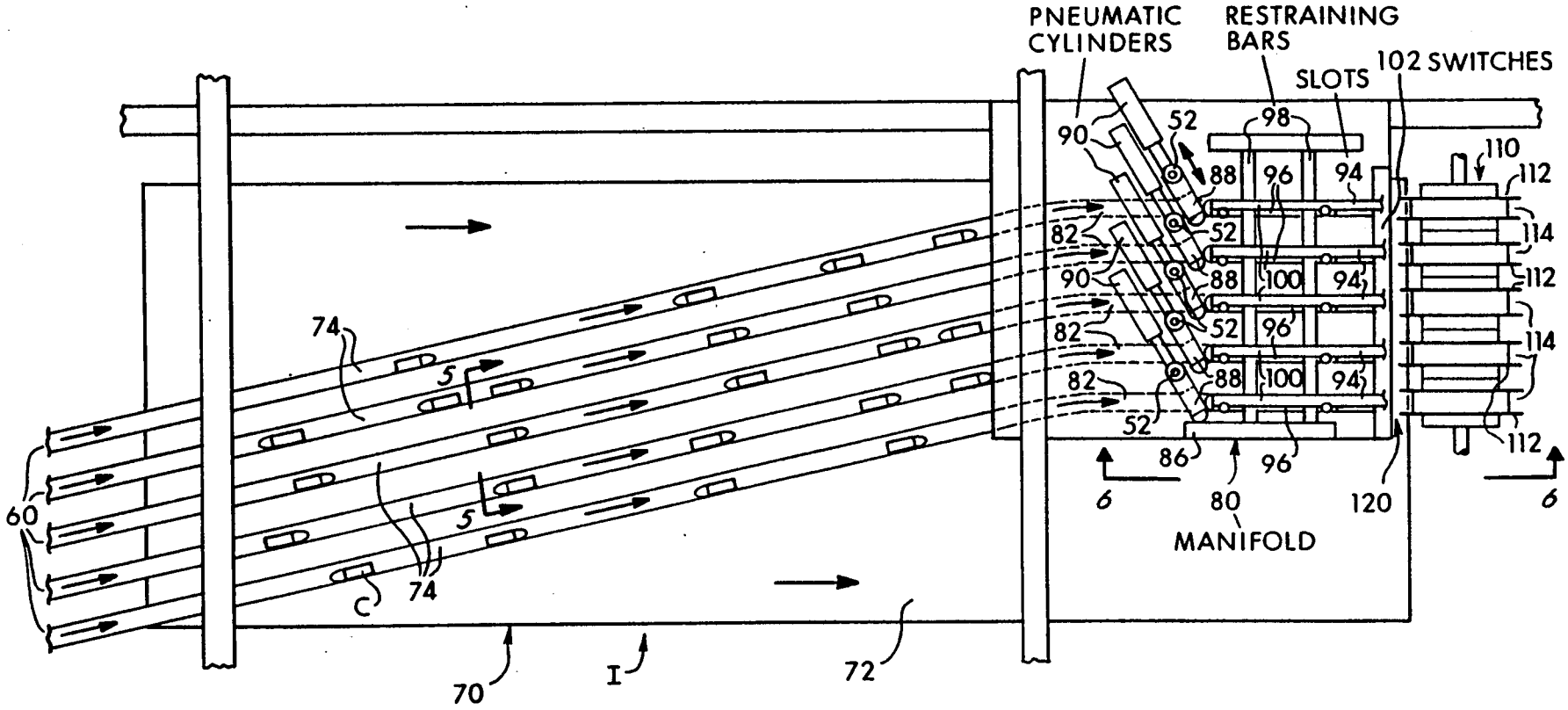
FIG. 4 is a top view of the conveyor with a partial cutaway view of the manifold gate and float mechanism.

The conveyor table: The conveyor table 70 includes a rubber mat conveyor belt 72 rotatable driven over the conveyor table 70 by rollers 76, 78 at each end of the table 70, one 78 of which is rotatably driven by variable speed drive motor D (not shown) as illustrated in FIGS. 1 and 4. Open topped feed channels 74 are mounted on the conveyor table 70 aligned with the feed tubes 60 and mounted diagonally relative to the longitudinal axis of the conveyor table 70 and the direction of movement of the conveyor belt 72. The feed channels 74 lie over the top of the conveyor belt 72 so the belt is able to move freely beneath the feed channels 74. The feed channels 74 extend to the manifold 80 mounted on the distal end 76 of the conveyor table. The operation of the manifold with be discussed fully below.

Figure 5:
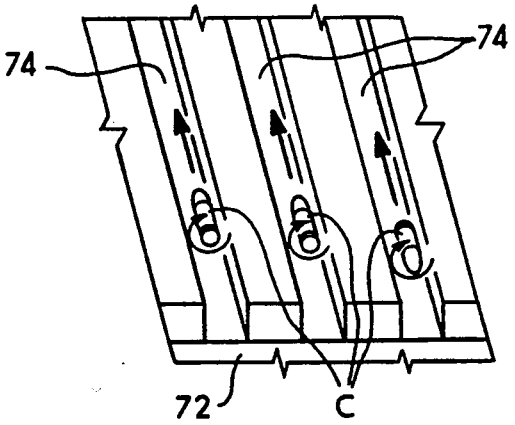
FIG. 5 is a cutaway view along line 5—5 showing a cartridge spinning in a feed channel.

The cartridges are conveyed from the feed tubes 60 to the manifold 80 through the feed channels 74 due to frictional engagement of the cartridges by the conveyor belt 72. The diagonal placement of the feed channels 74 relative to the direction of movement of the conveyor belt 72 causes the cartridges to spin as they are moved along the feed channels 74 as illustrated in FIG. 5. The operator of the apparatus is positioned in the inspection area I to observe the cartridges in the open-topped feed channels 74 as they spin in the channels. Defects in the cartridges are easily spotted in the cartridges as discolorations. The cartridges are spun several times as they move towards the manifold so the operator is able to visually inspect 100% of the cartridge as it spins. The operator can also vary the speed of the operation of the conveyor belt as necessary to keep up with the inspection process.

Figure 6A:
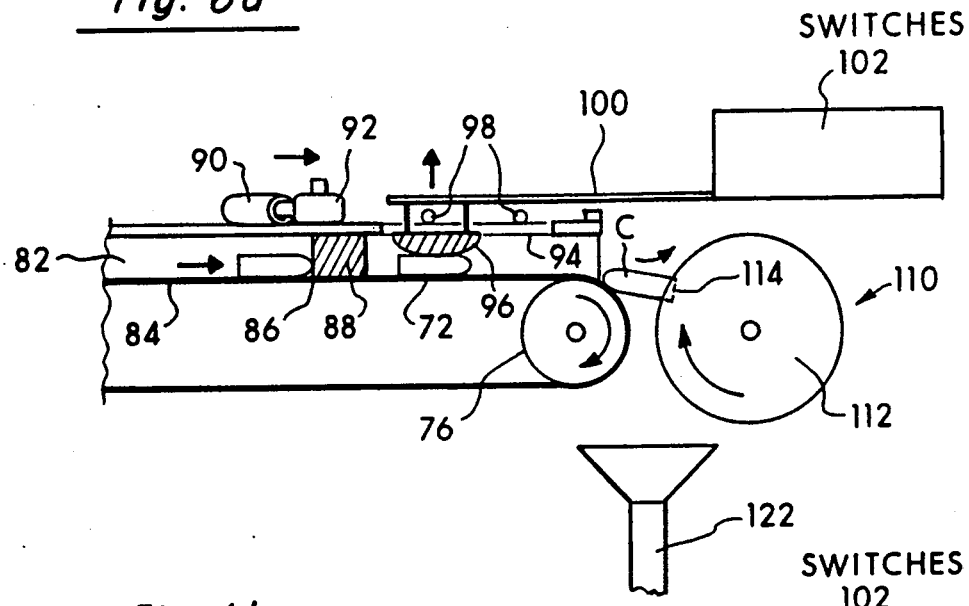
FIGS. 6(*a–c*) are cutaway views of the orienting device.
Figure 6B:
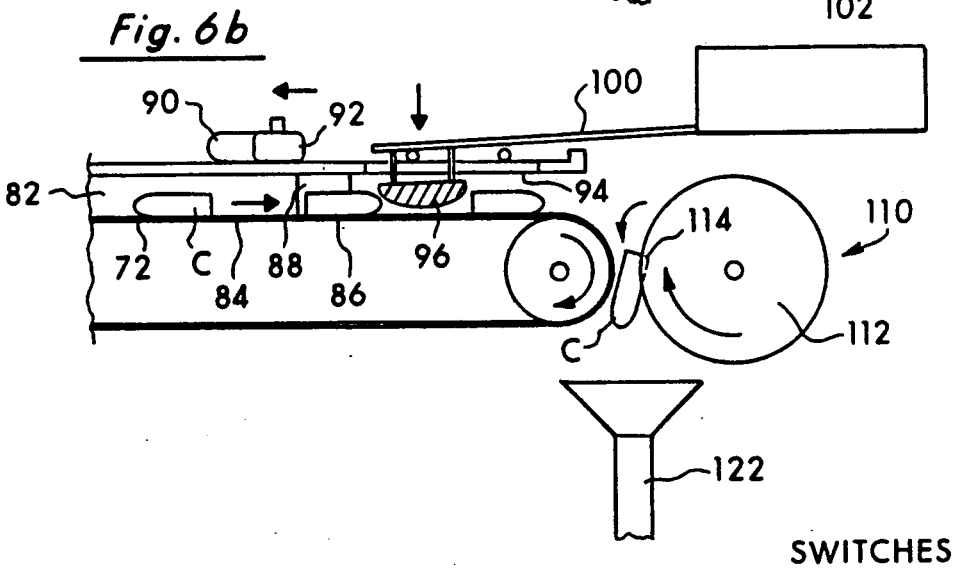
Figure 6C:
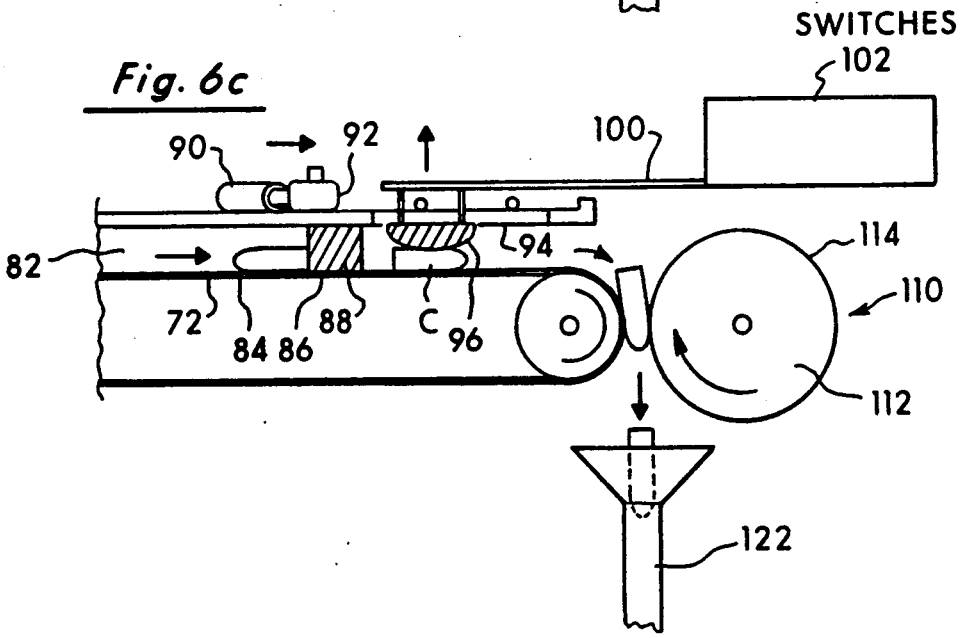

The manifold: The cartridges C enter the manifold 80 mounted at the end of the feed channels 74 after exiting the inspection area I illustrated in FIGS. 1 and 4. The cartridges are still being moved by the conveyor belt 72 at this point. The manifold 80 includes channels 82 illustrated in FIGS. 4 and 6*a*–6*c* formed on the lower side 84 illustrated in FIGS. 6*a*–6*c* of the manifold 80 through which the cartridges are guided. At the mid-portion 86 of the manifold 80 are gates 88 as shown in FIGS. 6*a*–6*c* which are mounted to slide across each channel 82 independent of the other gates 88 to block and open each channel 82 respectively. The gates 88 are mounted by eccentric bushings 92 to respective pneumatic cylinders 90 on the upper side of the manifold. The cylinders 90 are controlled by switches as will be discussed fully below. As the cylinders 90 are actuated, the gates 88 are opened and closed, thus controlling the feeding of the cartridges individually through the respective channels 82.

Elongated slots 94 are formed in the channels 82 in the area beyond the gates 88, extending through the manifold in each of the channels 82. Floats 96 lie within the slots 94 to slide vertically within the slots 94. Two restraining bars 98 extend across the width of the upper side of the manifold above the slots 94. The floats 96 are secured below the restraining bars 98 to switch rods 100 above the restraining bars 98. The spacing between the rods 100 and floats 96 is such that the floats 96 extend slightly down into the channels 82. The rods 100 extend upwardly at an angle to switches 102 mounted above the orienting device 110. After a cartridge travels through an open gate 88 it passes under a float 96 which is raised upward. The action of the float 96 moving upward moves the rod 100 upwards against the trigger 104 of the switch 102 which controls the pneumatic cylinder 90 for the gate 88 of that channel 82. The pneumatic cylinder 90 is actuated which closes the respective gate 88 preventing the next cartridge from passing through. After the cartridge passes entirely from under the float 96, typically a distance of 3 inches, the float 96 drops back down which causes the rod 100 to release the trigger 104 of the switch 102. This causes the switch 102 to actuate the pneumatic cylinder 90 again which opens the gate 88 for the next cartridge to pass through. This creates a pulsing mechanism to ensure proper spacing of the cartridges for the orienting device 110. The pneumatic cylinders 90 are also controlled by a second set of switches which will be discussed below.

The orienting device: The cartridges are to be loaded nose downward into the containers. In order to ensure that the cartridges enter the loading mechanism 120 illustrated in FIG. 1 nose downward, the apparatus includes an orienting device 110 as illustrated in FIG. 6. The orienting device includes a set of grooved wheels 112 rotatably mounted on the frame adjacent to and spaced from the distal end of the manifold 80 and the conveyor belt 72. The wheels 112 are spaced from the manifold and belt a distance slightly greater than the diameter of the cartridges. Each of the wheels 112 has a groove 114 formed therein wider than the nose of the cartridges but narrower than the rear end of the cartridge. Each groove 114 is aligned with a channel 82 exiting from the manifold 80. The wheels 112 are rotated by the conveyor drive motor D (not shown) mounted on one side of the system, at a speed greater than the speed of the conveyor belt 72.

As the cartridges exit from the manifold 80, they start to drop downward into the spacing between the wheels 112 and the manifold 80. Should the cartridge enter the spacing with the rear end first, as illustrated in FIG. 6(*a*), the sides of the groove 114 will engage the rear of the cartridge and carry it upwards until it is substantially vertically oriented with the cartridge nose downward. A spring clip (not shown) prevents the cartridge from continuing over the wheel. The weight of the cartridge nose will overcome the frictional engagement of the sides of the groove 114 and the cartridge will drop downward, nose first, into the loading mechanism 120 as illustrated in FIG. 6(*b*). If a cartridge enters the spacing nose first, the sides of the groove 114 of the wheel 112 will not engage the cartridge nose and the weight of the nose of the cartridge will cause it to drop downward into the loading mechanism 120 as illustrated in FIG. 6(*c*). The pulsing mechanism of the manifold is necessary to ensure that the orienting process can take place without another cartridge emerging from the manifold to jam the orienting device.

Another embodiment of the orienting device (not shown) is similar to the above-described mechanism except the spring clip is removed. Cartridges which enter the spacing nose first continue to drop downwards into the loading mechanism. Cartridges which enter rear first, or cartridges which are of a different caliber or missing the cartridge nose continue to be grasped by the side walls of the grooves of the wheel and are carried over the top of the wheel to be culled from the apparatus.

Figure 7:
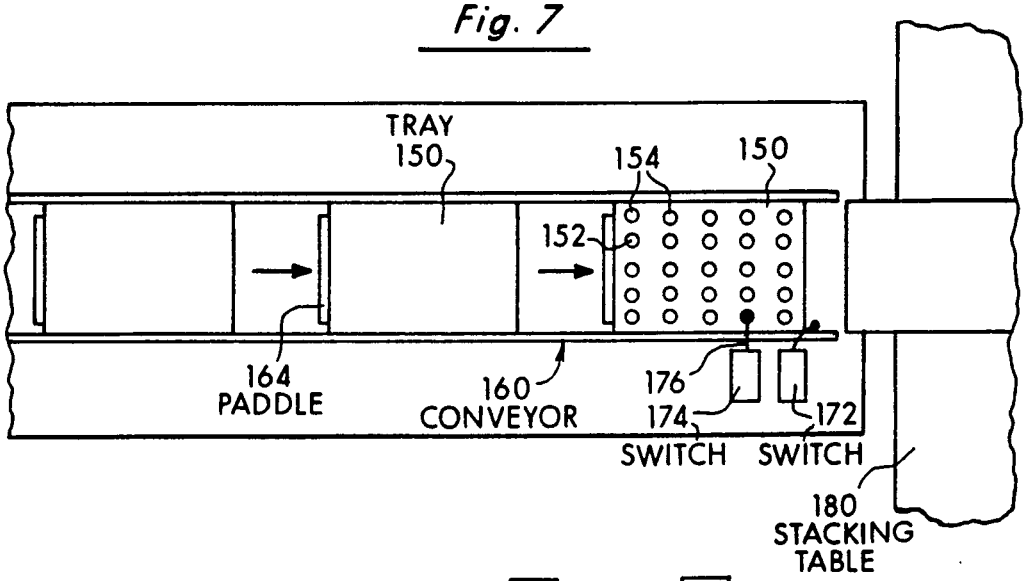
FIG. 7 is a view of the lower conveyor belt.

The loading mechanism: The cartridges drop from the orienting device 110 into the loading mechanism 120 shown in FIG. 1 by gravity. Lower feed tubes 122 are mounted onto a support plate 124 as shown in FIG. 1 aligned with the grooves 114 in the orienting device and exit channels 82 of the manifold to guide the cartridges into position to be loaded into the containers on the lower conveyor table 160 as illustrated in FIG. 7. The loading mechanism 120 as illustrated in FIG. 1 includes a loading gate 126 mounted on the lower end of arm 128 which is pivotally mounted on the plate 124 as illustrated in FIG. 1. The upper end 132 of the pivot arm 128 is attached to a solenoid 134 extending through an opening in the plate 124.

The loading gate 126 obstructs the bottom openings of the lower feed tubes 122 to prevent the cartridges from dropping through until all the feed tubes 122 contain cartridges. This prevents partial filling of the containers. Individual switches 138 shown in FIG. 1 are mounted on each of the lower feed tube so their triggers 140 extend partially into the respective feed tube 122. As a cartridge drops into position in the respective feed tube, the trigger 140 is depressed and the switch 138 signals the solenoid 134. When all of the tubes 122 have cartridges contained therein, and all of the switches 138 have been triggered, the solenoid 134 is actuated causing the arm 128 to pivot moving the loading gate 126 from the ends of the feed tubes 122. The cartridges drop into the holes in the container which has been positioned below.

To prevent the tubes 122 from backing up cartridges into the orienting device 110 and manifold 80 while one or more tubes 122 is still waiting for a cartridge, another set of switches 142 are mounted near the upper end of the feed tubes 122. Should a tube become filled with cartridges up to the upper switch 142 of that feed tube, the switch 142 actuates the pneumatic cylinder 90 controlling the gate 88 of the channel 82 feeding that tube 122. The gate 88 is closed, preventing additional cartridges from feeding into that tube 122 until the loading gate 126 is able to release cartridges into the container. If there is a problem in one or more of the channels somewhere along the entire process, the other channels will begin backing up in the inspection area, thus alerting the operator of a possible problem.

The solenoid 134 operating the loading gate 126 is also controlled by the container positioning device to ensure that the cartridges will not be released until the containers are in proper position as will be discussed fully below.

The container positioning device: Most cartridges are packed in containers of a standard shape and size. The apparatus of the current invention is designed so that varying sizes and shapes of containers and ammunition can be handled. A typical box is described as the preferred embodiment for descriptive purposes. This box 150 has a set of ten rows 154 with five holes 152 in each row for holding cartridges. The holes 152 in each row are spaced to be aligned with the lower feed tubes 122 of the loading mechanism 120. A stack of boxes are inserted in the proximate end of the frame above the lower conveyor belt 160 as illustrated in FIG. 1 at 165. The operator of the apparatus can easily drop in additional boxes as needed. The lower conveyor belt 160 is rotatably driven by drive motor 162 which can be incrementally driven as will be later discussed. The lower conveyor belt 160 includes upstanding paddles 164 spaced along the length of the belt 160 extending transversely to the direction of travel of the belt. As the belt 160 is driven below the stack of empty boxes, a paddle 164 will push one of the boxes 150 from under the stack and towards the loading mechanism 120 and the next box 150 will drop down onto the belt 160.

Near the distal end of the belt 160 adjacent to the loading mechanism 120 are two switches 172, 174 illustrated in FIG. 7. Switch 172 is located so that it is triggered by a box 150 as the first row 154 of holes 152 of the box is aligned directly beneath the lower feed tubes 122. This stops the drive motor 162 from advancing the conveyor belt 160. At this point, the trigger arm 176 of the second switch 174 extends over the top of the box 150 and down into a hole 152 of the second row 154 of the box. A switch (not shown) triggered by the action of the loading gate 126 signals the conveyor drive motor 162 that the row 154 has been filled and the conveyor advances the box forward. The trigger arm 176 of the second switch 174 moves upward out of the hole 152 and onto to the top of the box until it contacts the next row 154 of holes 152. As it contacts the next row of holes, it drops downward into a hole in that row which triggers the switch 174 which stops the conveyor drive motor 162. The loading gate 126 is not able to be actuated until the switches 172, 174 are both opened. The trigger arm 176 of the switch 174 will perceive the end of the box 150 as another row 154 so the last row in the box will be filled. After the box is filled, the box moves past switch 172 which is then closed so the conveyor continues to move until the next box 150 is in position.

Other variations are contemplated instead of the incremental driving of the conveyor belt. For instance, a continuously driven conveyor belt could be used which activates the loading gate as each empty row passes beneath the loading gate. Other variations not requiring the use of a conveyor belt are also considered to be within the range of the scope of the invention, such as directly loading into a stack of empty containers which can then be pushed aside.

Figure 8:
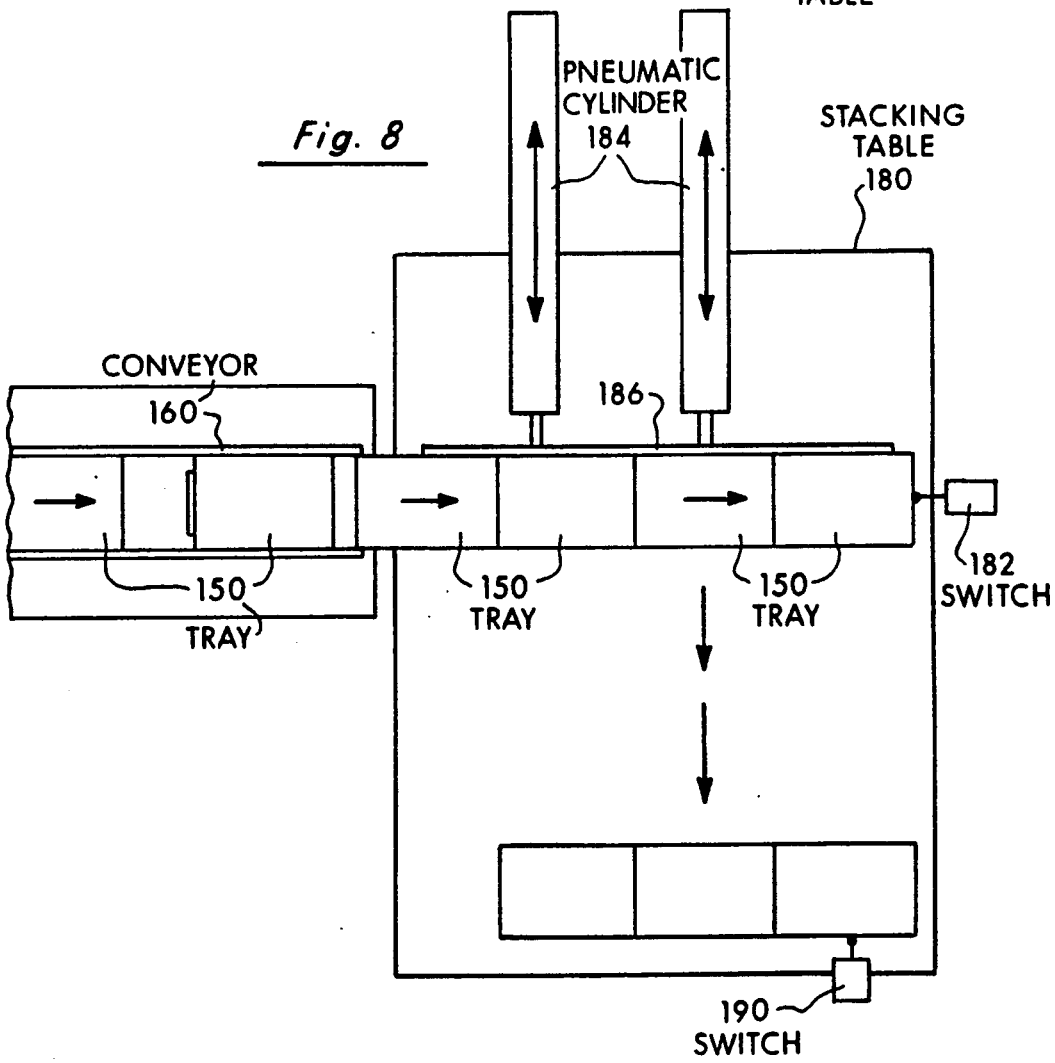
FIG. 8 is a view of the stacking table.

The stacking table: The filled boxes 150 are moved by the conveyor 160 onto a stacking table 180 adjacent the end of the conveyor belt 160 as illustrated in FIG. 8. The filled boxes are moved by the next box farther onto the table 180 until the end box contacts a 182 switch mounted on the far end of the table 180. The switch 182 signals two pneumatic cylinders 184 which operates a pusher arm 186. The pusher arm 186 includes a bar 188 extending the full length of the table. The cylinders 184 move the pusher arm 186 a distance slightly greater than the width of the boxes to move the boxes across the table 180. Additional rows continue to be moved over on the table until the first row of boxes contacts switch 190. This switch 190 causes the entire apparatus to turn off. This signals the operator to unload the table.

In the preferred embodiment the table 180 is of sufficient size to be able to substantially empty the reservoir 20 filled to capacity. This enables the operator to empty the stacking table 180 and refill the reservoir 20 without leaving the apparatus operating unattended. In one embodiment, the stacking table is able to hold five rows of boxes with eight boxes in each row. Each box holds five cartridges per row with ten rows per box for an uninterrupted run of 2000 cartridges.

OPERATION OF THE DEVICE

The apparatus is designed to be operated by one to two operators without requiring continuous repetitive manual labor. An operator first checks to see that the appropriate feed block plate 30 is installed in the reservoir 20 for the ammunition cartridges to be loaded. The operator then fills the reservoir with a bulk weight of loose ammunition cartridges. The operator can also fill the stack of empty containers to be filled. The apparatus is then turned on causing the dowel rods to reciprocate in the reservoir. The loose cartridges are oriented vertically and dropped down through the feed block into feed tubes 60. The cartridges drop due to gravity down through the feed tubes onto the conveyor belt 72 and into the feed channels 74.

There the cartridges are spun by the action of the conveyor belt forcing the cartridges through the diagonal mounted feed channels through an inspection area. The operator can observe the cartridges in this area to look for discolorations or imperfections in the cartridges which indicate defects. The rate of travel of the cartridges can be controlled by the variable speed conveyor belt.

The cartridges are moved from the inspection area into the manifold 80 where the pulsing mechanism spaces the cartridges apart before entering the orienting device. The orienting device ensures that the cartridges are dropped into the loading mechanism nose downward. Switches in the loading mechanism monitor the lower feed tubes until the feed tubes all contain cartridges. The loading gate is then actuated to drop the cartridges into a row of holes in the container positioned below. Another set of switches in the loading mechanism monitor the tubes so the tubes do not overflow into the orienting mechanism.

The containers are positioned below the loading mechanism by a lower conveyor belt. The position of the containers are controlled by switches which operate the conveyor drive motor as well as controlling the loading mechanism so that cartridges are not loaded until the rows in the containers are in the proper position.

The filled boxes are moved by the conveyor belt onto an adjacent stacking table. The boxes are moved farther onto the table by the next arriving box until the end of the row contacts a switch which actuates a pusher arm which moves the entire row over. Additional rows are moved onto the table until the end row contacts another switch, which turns the entire apparatus off so the operator can unload the table.

The above apparatus is designed to load loose ammunition cartridges into containers for packaging while allowing inspection of the cartridges for defects at a high capacity rate. Previous devices required intensive repetitive manual labor and were able to operate at a rate up to 5000 rounds per hour as compared to 28,000 rounds per hour with the current invention.

The above description of the preferred embodiment is meant for descriptive purposes only and is not meant to limit the claimed invention. Other variations and embodiments are contemplated within the range and scope of the inventive concept. Other variations include but are not limited to the use of roller mikes in lieu of the conveyor belt and roller wheels in lieu of the dowel rods. The reservoir can be of other shapes and sizes as well. The entire apparatus is covered by shrouds (not shown) for safety purposes except for the inspection area.

I claim:

1. An apparatus for inspecting and loading loose ammunition cartridges; said apparatus comprising:

a frame;

means on said frame for holding a plurality of loose ammunition cartridges;

first feed tube means on said frame for moving said loose ammunition cartridges from said holding means;

first feeding means on said frame for feeding said loose ammunition cartridges into said first feed tube means;

means on said frame for loading said loose ammunition cartridges into containers;

means on said frame for moving said loose ammunition cartridges from said first feed tube means to said loading means for loading said loose ammunition cartridges into containers;

means on said moving means for enabling visual inspection of said loose ammunition cartridges for defects;

said container loading means including:

means for orienting said loose ammunition cartridges nose downward;

a plurality of second feed tube means for directing said cartridges into position to be loaded into said containers by said loading means;

means for sensing the presence of said loose ammunition cartridges in each of said plurality of feed tube means;

means for generating a signal in response to said sensing means when all of said plurality of feed tubes have ammunition cartridges present;

means for selectively preventing said loose ammunition cartridges from being loaded into said containers; and means for actuating said prevention means in response to said generated signal to load said loose ammunition cartridges into said container.

2. The apparatus of claim 1 wherein said holding means comprise an open-topped container having slanted sides.

3. The apparatus of claim 1 wherein said container loading means further comprise:

second sensing means to sense a predetermined number of cartridges in any of said plurality of feed tubes when said prevention means prevent said cartridges from being loaded;

means to generate a signal in response to said second sensing means;

and means to stop cartridges from entering the feed tubes which are holding said predetermined number of cartridges in response to said signal.

4. The apparatus of claim 1 wherein said container loading means comprises means to move each of said containers into a predetermined position to be loaded relative to said directing means.

5. An apparatus for inspecting and loading loose ammunition cartridges; said apparatus comprising:

a frame;

means on said frame for holding a plurality of loose ammunition cartridges;

first feed tube means on said frame for moving said loose ammunition cartridges from said holding means;

first feeding means on said frame for feeding said loose ammunition cartridges into said first feed tube means;

means on said frame for loading said loose ammunition cartridges into containers;

means on said frame for moving said loose ammunition cartridges from said first feed tube means to said loading means for loading said loose ammunition cartridges into containers;

said container loading means including:

means for orienting said loose ammunition cartridges nose downward;

means for directing said cartridges into position to be loaded into said containers by said loading means;

means for sensing the presence of one of said containers in a predetermined position relative to said directing means;

means for generating a signal in response to said sensing means;

means for selectively preventing said loose ammunition cartridges from being loaded into one of said containers when said container is not in said predetermined position relative to said directing means; and means for actuating said prevention means in response to said generated signal when said container is in said predetermined position relative to said directing means to load said cartridges into said container.

6. An apparatus for inspecting and loading loose ammunition cartridges; said apparatus comprising:

a frame;

means on said frame for holding a plurality of loose ammunition cartridges;

first feed tube means on said frame for moving said loose ammunition cartridges from said holding means;

first feeding means on said frame for feeding said loose ammunition cartridges into said first feed tube means;

means on said frame for loading said loose ammunition cartridges into containers;

means on said frame for moving said loose ammunition cartridges from said first feed tube means to said loading means for loading said loose ammunition cartridges into containers;

said container loading means including:

means for orienting said loose ammunition cartridges nose downward;

means for directing said cartridges into position to be loaded into said containers by said loading means;

a conveyor belt;

first sensing means for sensing when one of said containers is in a predetermined position relative to said directing means to load cartridges in the first empty row of said container;

means for generating a first signal in response to said first sensing means;

means for loading said loose ammunition cartridges from said directing means into the first row of said container in response to said first signal;

second sensing means for sensing the presence of the next empty row of said container;

means for generating a second signal in response to said second sensing means;

means for actuating said conveyor belt in response to said second signal so the next empty row of said container is positioned relative to said directing means after the previous row is filled so said first sensing means senses an empty row under said directing means;

third sensing means for sensing the end of said container;

means for generating a third signal in response to said third sensing means; and means for actuating said conveyor belt to move the next container in position to be loaded.

7. The apparatus of claim 6 wherein said container moving means further comprise means to store empty containers to be filled; and means to move said empty containers from said storage means onto said conveyor belt.

8. An apparatus for inspecting and loading loose ammunition cartridges; said apparatus comprising:

a frame;

means on said frame for holding a plurality of loose ammunition cartridges;

first feed tube means on said frame for moving said loose ammunition cartridges from said holding means;

first feeding means on said frame for feeding said loose ammunition cartridges into said first feed tube means;

means on said frame for loading said loose ammunition cartridges into containers;

means on said frame for moving said loose ammunition cartridges from said first feed tube means to said loading means for loading said loose ammunition cartridges into containers;

said container loading means including:

an extension table to store said containers which have been fully filled;

means for moving said filled containers onto said extension table in a single row;

first means for sensing when a predetermined number of filled containers have been moved onto said table in said single row;

means for generating a signal in response to said sensing means;

means for pushing said row in a direction perpendicular to said row in response to said signal;

second sensing means for sensing when a predetermined number of rows are on said table;

means for generating a second signal in response to said second sensing means; and means for stopping said apparatus in response to said second signal.

9. An apparatus for inspecting and loading loose ammunition cartridges; said apparatus comprising:

a frame;

means on said frame for holding a plurality of loose ammunition cartridges;

first feed tube means on said frame for moving said loose ammunition cartridges from said holding means;

a feed tube block having a row of spaced holes mounted in the bottom of said holding means, said holes sized slightly larger in diameter than the diameter of said loose cartridges and connected to said first feed tube means;

a plurality of dowel rods of staggered height mounted on said frame to vertically reciprocate through said block and said holding means;

means for vertically reciprocating said dowel rods through said block and said holding means;

said dowel rods being arranged so that each of said holes is surrounded by four of said dowel rods in a close square pattern about said holes and each dowel rod is of a different height than the adjacent dowel rods so as said rods are moved upward through said holding means, the loose ammunition cartridges are titled by the staggered height of said rods in a substantially vertical orientation and as said rods are moved downward, the vertically tilted cartridges are prevented from falling sideways between said rods and are fed into said spaced holes;

means on said frame for loading said loose ammunition cartridges into containers; and means on said frame for moving said loose ammunition cartridges from said first feed tube means to said loading means for loading said loose ammunition cartridges into containers.

10. The apparatus of claim 9 wherein said reciprocating means comprise a mounting block to which said dowel rods are attached; an eccentric crank arm attached to said mounting block and means to rotate said eccentric crank arm to vertically reciprocate said dowel rods.

11. The apparatus of claim 9 wherein said feed tube means comprise a plurality of feed tubes mounted to said feed block so the cartridges are fed through said spaced holes and into said feed tubes to said moving means, said plurality of feed tubes equal in number to the number of holes in each row of said container to filled.

12. The apparatus of claim 9 wherein said feed tube block comprises a plurality of interchangeable blocks having spaced holes of differing sizes matching different sizes of ammunition cartridges.

13. An apparatus for inspecting and loading loose ammunition cartridges; said apparatus comprising:

a frame;

means on said frame for holding a plurality of loose ammunition cartridges;

first feed tube means on said frame for moving said loose ammunition cartridges from said holding means;

first feeding means on said frame for feeding said loose ammunition cartridges into said first feed tube means;

means on said frame for loading said loose ammunition cartridges into containers;

a horizontal table between said first feed tube means and said container loading means;

a rotating conveyor belt on said horizontal table for frictionally engaging said cartridges to move said cartridges from said first feed tube means to said container loading means; and open topped feed channel means mounted on said horizontal table diagonally over said conveyor belt for guiding said cartridges along said table so said cartridges are force to spin as said conveyor belt moves said cartridges along said diagonal channels so each cartridge can be visually inspected by the operator of the apparatus as each cartridge is rotated.

14. An apparatus for inspecting and loading loose ammunition cartridges; said apparatus comprising:

a frame;

means on said frame for holding a plurality of loose ammunition cartridges;

first feed tube means on said frame for moving said loose ammunition cartridges from said holding means;

first feeding means on said frame for feeding said loose ammunition cartridges into said first feed tube means;

means on said frame for loading said loose ammunition cartridges into containers;

means on said frame for moving said loose ammunition cartridges from said first feed tube means to said loading means for loading said loose ammunition cartridges into containers;

said container loading means including:

a plurality of second feed tube means for directing said cartridges into position to be loaded into said containers by said loading means;

rotating wheel means mounted adjacent to said moving means but spaced from said moving means distance greater than the diameter of said cartridges;

said directing means located below said spacing between said wheel means and said moving means;

said wheel means rotating at a speed greater than the speed that said moving means move said cartridges;

a groove formed in said wheel means having a ) narrower than the rear of said cartridge but wider than the cartridge nose;

whereby the weight of said cartridge nose will force the cartridge to fall into the said spacing nose downward into said directing means should the cartridge enter said orienting means nose first; and said groove will engage the rear of said cartridge of cartridges entering the orienting means rear first to pull said cartridge onto said wheel until the weight of said cartridge nose overcomes the frictional engagement of said cartridge and said groove so said cartridge will fall into said spacing nose downward into said directing means.

15. The apparatus of claim 14 wherein said moving means further comprise means to space said cartridges a predetermined distance from one another before said cartridges enter said orienting means.

16. The apparatus of claim 15 wherein said spacing means comprise a gate formed in each of said feed channels, means to open and close said gate in said channel; means to actuate said open and closing means; means to sense the presence of a cartridge in each of said channels; and means to signal the actuating means in response to said sensing means so said gate blocks said channel to prevent another cartridge from entering said channel until said sensing means no longer senses the presence of a cartridge.

17. An apparatus for inspecting and loading loose ammunition cartridges; said apparatus comprising:

a frame;

means on said frame to hold a plurality of said loose ammunition cartridges;

a feed tube block having a row of spaced holes mounted in the bottom of said holding means, said holes sized slightly larger in diameter than the diameter of said loose cartridges;

a plurality of dowel rods of staggered height mounted on said frame to vertically reciprocate through said block and said holding means;

means to vertically reciprocate said dowel rods through said block and said holding means;

said dowel rods being arranged so that each of said holes is surrounded by four of said dowel rods in a close square pattern about said holes and each dowel rod is of a different height than the adjacent dowel rods so as said rods are moved upward through the holding means, the loose ammunition cartridges are tilted by the staggered height of said rods in a substantially vertical orientation and as said rods are moved downward, the vertically tilted cartridges are prevented from falling sideways between said dowel rods and are fed into said spaced holes;

feed tube means connected to said feed tube block to receive said loose cartridges from said holding means;

a horizontal table mounted to said frame;

open topped feed channel means mounted diagonally on said horizontal table;

a rotating conveyor belt on said horizontal table beneath said feed channel means to frictionally engage said cartridges to move said cartridges from said feed tube means to said container loading mean;

means to visually inspect the cartridges as the conveyor belt moves said cartridges;

said inspection means comprising diagonal placement of said feed channel means relative to the direction of rotation of said conveyor belt forcing said cartridges to spin by the action of said conveyor belt as said conveyor belt moves said cartridges along said diagonal channels so each cartridge can be visually inspected for defects by the operator of the apparatus as each cartridge is rotated;

said container loading means comprising means to orient said cartridges nose downward;

said container loading means comprises a plurality of feed tubes;

first sensing means to sense the presence of said cartridges in each of said plurality of feed tubes;

means to generate a first signal in response to said first sensing means;

second sensing means to sense a predetermined number of cartridges in any of said plurality of feed tubes when said prevention means prevent said cartridges from being loaded;

means to generate a second signal in response to said second sensing means;

and means to stop cartridges from entering the feed tubes which have said predetermined number of cartridges in response to said second signal;

means to prevent said cartridges from being loaded into said containers;

means to actuate said prevention means in response to said signal when said cartridges are present in all of said plurality of feed tubes to allow said cartridges to be loaded into said containers.

18. The apparatus of claim 17 wherein said container loading means further comprise:

a second conveyor belt, third sensing means to sense when each of said containers is in a predetermined position relative to said directing means to load each row of said container;

means to generate a third signal in response to said third sensing means;

means to load the first row of said container in response to said third signal;

fourth sensing means to sense the presence of the next empty row of said container;

means to generate a fourth signal in response to said fourth sensing means;

means to actuate said conveyor belt in response to said fourth signal so the next empty row is positioned relative to said directing means after the previous row is filled;

fifth sensing means to sense the end of said container;

means to generate a fifth signal in response to said fifth sensing means; and means to actuate said conveyor belt to move the next container in position to be loaded.

19. The apparatus of claim 17 wherein said container moving means further comprise an extension table to store said containers which have been fully filled;

means to move said filled containers onto said extension table in a single row;

means to sense when a predetermined number of filled containers have been moved onto said table in said single row;

means to generate a signal in response to said sensing means;

means to push said row in a direction perpendicular to said row in response to said signal;

second sensing means to sense when a predetermined number of rows are on said table;

means to generate a second signal in response to said second sensing means;

means to stop said apparatus in response to said second signal.

20. The apparatus of claim 17 wherein said reciprocating means comprise a mounting block to which said dowel rods are attached; an eccentric crank arm attached to said mounting block and means to rotate said eccentric crank arm to vertically reciprocate said dowel rods.

21. The apparatus of claim 17 wherein said feed tube block comprises a plurality of interchangeable blocks having spaced holes of differing sizes matching different sizes of ammunition cartridges.

22. The apparatus of claim 17 wherein said orienting means comprise:

rotating wheel means mounted adjacent to said moving means but spaced from said moving means a distance greater than the diameter of said cartridges;

said directing means located below said spacing between said wheel means and said moving means;

said wheel means rotating at a speed greater than the speed that said moving means move said cartridges;

a groove formed in said wheel means having a width narrower than the rear of said cartridge but wider than the cartridge nose;

whereby the weight of said cartridge nose will force the cartridge to fall into said spacing nose downward into said directing means should the cartridge enter said orienting means nose first; and said groove will engage the rear of said cartridge of cartridges entering the orienting means rear first to pull said cartridge onto said wheel until the weight of said cartridge nose overcomes the frictional engagement of said cartridge and said groove so said cartridge will fall into said spacing nose downward into said directing means.

23. The apparatus of claim 22 wherein said moving means further comprise means to space said cartridges a predetermined distance from one another before said cartridges enter said orienting means.

24. The apparatus of claim 23 wherein said spacing means comprise a gate formed in each of said feed channels, means to open and close said gate in said channel; means to actuate said open and closing means; means to sense the presence of a cartridge in each of said channels; and means to signal the actuating means in response to said sensing means so said gate blocks said channel to prevent another cartridge from entering said channel until said sensing means no longer senses the presence of a cartridge.

* * * * *